United States Patent [19]

Hunt

[11] Patent Number: 4,993,438

[45] Date of Patent: Feb. 19, 1991

[54] HAIR WEAVING COMB AND METHOD FOR USE

[76] Inventor: Marjorie A. Hunt, 6120 Nicollet Ave. South, Minneapolis, Minn. 55419

[21] Appl. No.: 331,346

[22] Filed: Mar. 31, 1989

[51] Int. Cl.[5] ..... A45D 24/04

[52] U.S. Cl. ..... 132/139; 132/150; 132/161; 132/208

[58] Field of Search ..... 132/124, 125, 126, 139, 132/148, 150, 158, 161, 901, 208

[56] References Cited

U.S. PATENT DOCUMENTS

| | | | |
|---|---|---|---|
| 952,491 | 3/1910 | Youngs | 132/161 |
| 2,785,688 | 3/1957 | Chester | 132/139 |
| 3,416,543 | 12/1968 | Hantman | 132/125 |
| 3,473,540 | 10/1969 | Bulow | 132/139 |
| 3,952,755 | 4/1976 | Fisher | 132/161 |
| 4,108,186 | 8/1978 | Esposto | 132/124 |
| 4,566,472 | 1/1986 | Mueller et al. | 132/161 |
| 4,815,484 | 3/1989 | Stevenson | 132/161 |

*Primary Examiner*—John G. Weiss
*Assistant Examiner*—Frank A. LaViola, Jr.
*Attorney, Agent, or Firm*—Palmatier & Sjoquist

[57] ABSTRACT

The present hair weaving comb for rapidly and evenly separating hair for highlighting and the like includes a set of legs extending from an elongate support member. Distal end portions of the legs include hair separating teeth for separating a section of hair into sub-sections. When the legs of the comb are initially inserted into a section of hair, the teeth create sub-sections of hair. When the legs are further inserted in the section of hair, the teeth group and displace alternate hair sub-sections away from other alternate hair sub-sections. The other alternate hair sub-sections are bypassed by the teeth and slide into hair-receiving slots formed between the spaced-apart legs of the hair weaving comb. When the legs are still further inserted through the hair section, the displaced hair sub-sections are pushed out of a hair-stylists's hand and readily fall out of the teeth of the distal end of the comb and down to the head of the customer. The hair weaving comb creates a number of thin hair sub-sections simultaneously from a wide hair section and hence provides an instantaneous separation of a section of hair. Furthermore, the hair weaving comb creates sub-sections of an equal width to provide an even coloring for highlighting of the hair. The hair weaving comb also includes a tapered rattail extension for creating sections of hair and comb-like teeth for detangling and smoothing the hair section to be separated by the hair weaving legs.

25 Claims, 5 Drawing Sheets

PRIOR ART

HAIR WEAVING COMB AND METHOD FOR USE

The present invention relates to devices for preparing hair for highlighting and more particularly to hair weaving combs.

BACKGROUND OF THE INVENTION

Hair highlighting is a selective coloring of hair. It is also known as a streaking, frosting, tipping, color texturing, partial lightening of hair, weaving or highlighting. The chemicals used for treating hair for highlighting include lighteners such as bleaching agents which remove all or some of the natural pigment, and coloring agents, toners, or tints which apply color directly to the hair. A toner is a semi-permanent color stain. After the chemicals have been applied to the hair and the desired color is achieved, the hair is shampooed or rinsed to remove the chemicals.

Two basic methods exist for highlighting hair. One of the methods is shown in FIG. 3 and includes the use of a perforated tight-fitting rubber or plastic cap and a crochet hook. The cap is placed on a customer's head and the hair strands to be highlighted are pulled by the crochet hook from the root area of the head and through the individual holes in the perforated cap. Chemicals such as bleach or tint are then applied to the pulled strands of hair lying outside the cap to create the desired hair color.

If bleach has been applied to the hair, the head is covered with a non-perforated plastic cap to contain the head's heat and keep the bleach warm and moist, which hastens the chemical reaction. After a desired period of time, the cap is removed and the hair is shampooed or rinsed with water to remove the bleach. Subsequently, a toner may be applied to the hair.

The cap method for highlighting hair is problematic. One of the problems is that it may be uncomfortable for the customer when strands of hair are pulled from the root area and through the cap perforations. Other problems are that the process is slow, unpredictable, and without pattern or style.

Additionally, it is difficult even with a transparent cap for a hair stylist to see the hair root area to determine whether the correct strands of hair are being pulled out from underneath the cap. Moreover, the bleach or coloring agent may seep unperceivably through the holes in the cap. The hidden chemical seepage to the hair underneath the cap causes blotch-like color accidents which the stylist is prevented from seeing and correcting until the coloring process is completed and the cap is removed.

Furthermore, a limited number of highlighting styles may be created with the cap method. Customized highlighting is typically not available with such a cap, which is especially unfortunate in an industry in which customization is the key to a successful business.

The second basic method for highlighting, as shown in FIGS. 4A and 4B, includes the use of a conventional rattail comb to section and separate hair to be highlighted. A rattail comb is a comb having conventional teeth, and a tapered, pointed extension or "rattail" extending from the portion of the comb with the teeth. In a hand weaving method using a rattail comb, a hair stylist forms or creates a section of hair by defining a thin rectangular like section of the scalp, as shown by the parallel lines in FIG. 6, with the pointed end of the tapered rattail extension. The stylist may actually run the pointed end of the rattail extension about a thin hypothetical rectangle on the scalp to create the section.

After a section of hair has been formed, the section of hair is then held between the fore and middle fingers of one hand, such as the left hand. The portion of the rattail comb with the conventional teeth is held with the thumb and fingers of the other hand, such as the right hand, with the rattail extension extending from the hand. Subsequently, with the pointed end of the tapered rattail extension leading the way, the rattail extension is weaved in and out of the thin section of hair in an up and down weaving manner. Accordingly, sub-sections or weaves of hair are created with sub-sections to be eliminated from highlighting woven below the rattail extension and the sub-sections to be highlighted woven above the rattail extension.

After the sub-sections or weaves have been formed by the rattail extension being fed through the hair section, the rattail extension of the comb is pushed downwardly toward the shoulder of the customer, pushing the unwanted hair below the rattail extension out of the stylist's left hand and back onto the head of the customer to be protected from highlighting. The sub-sections of hair remaining above the rattail extension is the weave portion and remains in the left hand of the stylist until it is laid onto foil, paper, or plastic-like pieces for treatment by highlighting chemicals such as tints o bleaches.

The foil, paper, or plastic like pieces contain and confine the hair so that the hair is controllable and separates and protects the confined hair to be chemically treated from hair which is to be retain its natural color. After one section of hair is weaved and color is applied, the hairstylist moves on to create another section of hair, which is weaved and colored, and proceeds to repeat the process until the entire head of hair has been sectioned, weaved, and colored.

The hand weaving method using the rattail extension requires an extremely competent hairstylist. One of the reasons the method requires a great amount of skill is the vast number of hairs on a human head. A head of hair may have 90,000 (ninety thousand) to 140,000 (one hundred and forty thousand) strands of hair. The average area of a head is about 120 square inches and an average of 1,000 hairs occupies each of the square inches of the head of hair.

With the hand weaving method using the rattail extension, one to approximately 100 (one hundred) sections may be formed on one head where each section measures approximately four inches across and one-eighth to one-half inches in height. Each section may be divided into three to 20 (twenty) subsections. Hence, three to 2,000 (two thousand) subsections of hair may be created on an entire head of hair.

With the hand weaving method using the rattail extension, each sub-section is desirably woven into an equal width. However, it requires an extraordinary amount of skill to quickly run the pointed end of the rattail extension in and out of one section of hair so that each of the possible 20 sub-sections or weaves is of equal width. Furthermore, if thin weaves are desired over the entire head of hair, it requires an even greater amount of skill to weave each of the sections identically so that each of the possible 2,000 sub-sections or weaves is of an equal width.

The hand weaving method with the rattail comb is time consuming even for the adept hairstylist. After each of the sections is weaved, it is confined to a protective piece of foil or plastic. Each of the sub-sections is then immediately chemically treated. If the time period between the chemical treatments of the first and last treated sub-sections of hair is too long, then the first and last treated sub-sections of hair may be of different tones, especially if the chemical applied to the hair is a fast acting lightener or bleach. Hence, the end results of the hand weaving method using the rattail comb may include an irregular coloring of the hair, as well as hair sub-sections of different thicknesses.

As previously mentioned, the current and only artform used more commonly today by creative hairstylists is the hand hairweaving method done with a rattail comb and a patient hairstylist weaving pieces all over the head. Not to discredit the first method mentioned, the cap technique, it is still used as well, but mainly, because, it is less time consuming and/or the stylist has less confidence or adeptness to use the hand weave method. The cap method is also more painful to the client because the hair is pulled through the holes in the cap with a crochet hook and can cause much discomfort. It is, therefore, another reason the hand weaving method is preferred if the stylist is adept and has mastered the technique.

Both methods leave alot to be desired for the more discriminating stylist. The cap method, besides being painful, is hard for the hair stylist to see the area from where the hair is being pulled from under the cap. Also, seapage of the bleach or color can occur thru the holes in the cap and can cause blotchey color accidents on the hair underneath the cap that the stylist does not see until the process is over, and the cap is removed. With the hand weave method, a certain amount of speed must be obtained so that the first section will be colored as evenly as the last section. This technique is difficult in maintaining consistancy and evenness in weaving the same size pieces and spaced the same distance thru out the head when time is of the essence with color processing while you work.

The comb I have designed will eliminate the time consuming and nerve racking method of hand weaving and the painful unexpecting cap method. My comb may have a rattail on the end used for sectioning the hair, with a regular and evenly spaced comb on one side, to comb the hair smooth and prepare it to be weaved, and on the other side of the comb, is the hairweaving comb. The hairweaving side of the comb will, in one step, push the unwanted hair not be weaved down and out of the way so that all remaining hair can be placed on pieces of foil to be colored.

There may be several combs made of the same basic design that would be spaced from close to far apart and with thin to thick weaves to allow for stylists creativity and individuality in expression of the artform of color texturizing, hairweaving or highlighting, (just a few of the names more commonly used to describe the process).

SUMMARY OF THE INVENTION

An object of the present invention is to provide a hair weaving comb for rapidly forming sub-sections or weaves of hair for highlighting.

Another object of the present invention is to provide a hair weaving comb for forming hair sub-sections of an exact, precise and desired width for a predictable style of highlighting.

A feature of the present invention is the provision in a hair weaving comb for rapidly and evenly separating hair for highlighting, of a number of elongate legs wherein the legs form separating means for separating sub-sections of hair to be highlighted from a section of hair.

Another feature of the present invention is the provision in a hair weaving comb for rapidly and evenly weaving hair for highlighting, of a number of elongate legs wherein each of the distal ends of the legs includes grabbing means for grabbing or catching or grouping alternate sub-sections of hair to be pushed back to the head and protected from highlighting chemicals and wherein the elongate legs form elongate slots for receiving sub-sections of hair which have been bypassed by the grabbing means and to which highlighting chemicals are applied.

Another feature of the present invention is the provision in a hair weaving comb for rapidly and evenly separating hair for highlighting, of a number of elongate legs wherein each of the distal ends of the legs include teeth means for grabbing hair to be pushed out of a hairstylists's hand and protected from highlighting and wherein the teeth means rapidly release the alternate sub-sections of hair after the alternate sub-sections of hair are pushed out of the hand of the hairstylist.

Another feature of the present invention is the provision in a method for rapidly and evenly separating hair for highlighting, of a weaving like step wherein sub-sections of hair groups of hair strands of equal width are simultaneously separated from a section of hair for highlighting.

Another feature of the present invention is the provision in a method for rapidly and evenly separating hair for highlighting, of a weaving like step wherein a hairstylist divides a section of hair into a plurality of sub-sections with a one directional movement of his or her hand.

An advantage of the present invention is that hair is rapidly separated for highlighting.

Another advantage of the present invention is that sub-sections of a uniform width are quickly divided out from a section of hair for highlighting. Hence, the present invention produces a head of hair that is evenly or orderly highlighted throughout and in a lesser amount of time than the hand weave method.

Another advantage of the present invention is that hair is highlighted in a predictable manner. A variety of hair weaving combs may be produced by the present invention. Each of the various hair weaving combs may have a certain spacing. For example, one hair weaving comb may create 8 individual sub-sections of a certain width within one section; another hair weaving comb may create 16 individual sub-sections of a thinner width within one section. Each of the different hair weaving combs may be color coded or imprinted with a certain number or letter. Therefore, a hairstylist could maintain records on individual customers who could refer to his or her desired type of highlighting.

Another advantage of the present invention is that it is inexpensive to manufacture and simple to operate. Accordingly, the present invention may encourage the less experienced hairstylist to terminate his or her use of the slow and painful cap and crochet hook method of highlighting and allow all stylists more confidence in producing more uniform highlighted hair colors.

DETAILED DESCRIPTION OF THE PREFERRED EMBODIMENTS

Figure 1A:
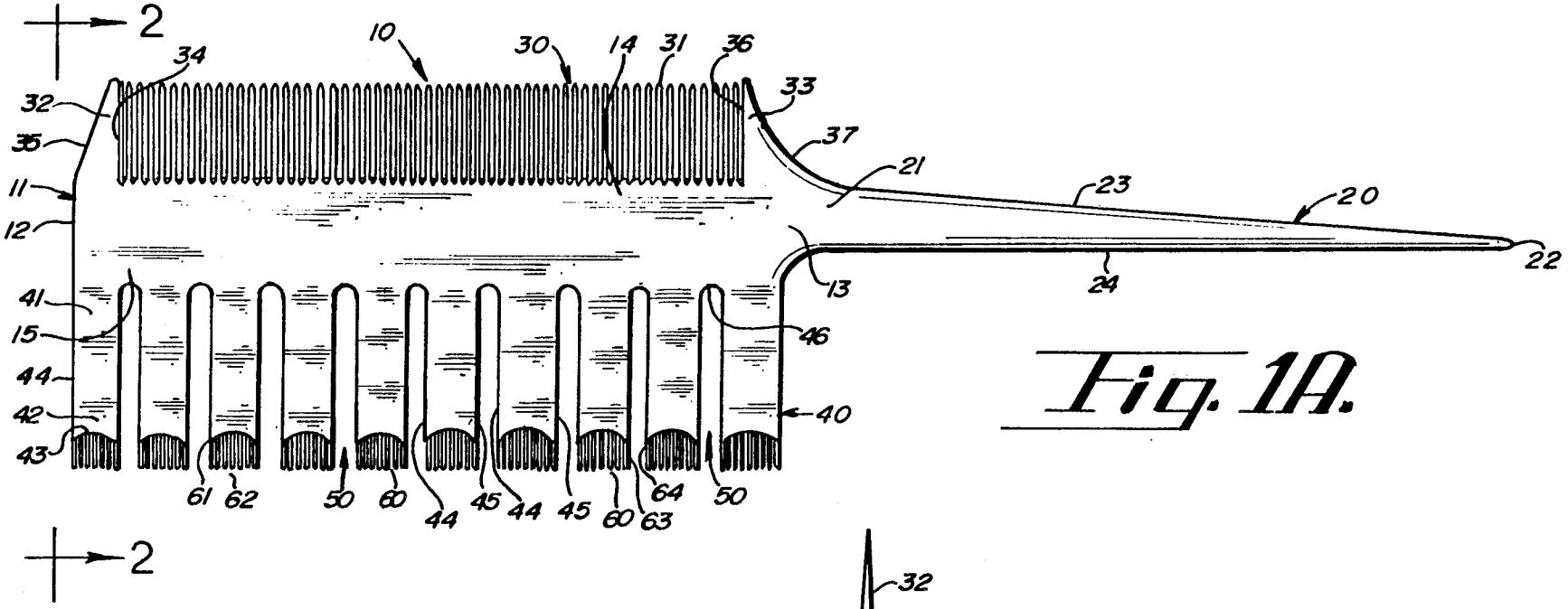
FIG. 1A shows a side elevation view of one of the embodiments of the present hair weaving comb for rapidly and evenly separating hair for highlighting.

As shown in FIG. 1A, a hair weaving comb for rapidly, evenly, and predictably forming hair sub-sections from a section of hair for highlighting and the like is designated by the reference numeral 10. The hair weaving comb 10 includes an elongate, longitudinal plastic like central support member 11 having a first end 12 and a second, rattail connected end 13. The elongate support member 11 further includes a first edge portion 14 and a second edge portion 15.

The rattail connected end 13 is integrally affixed to an elongate, longitudinal, plastic like rattail extension 20. The rattail extension 20 includes a wide end 21 integrally connected to the second end 13 of the support member 11 and a pointed end 22. The rattail extension 20 further includes a pair of tapering edges 23, 24 tapering from the wide end 21 to the pointed end 22.

Figure 2:
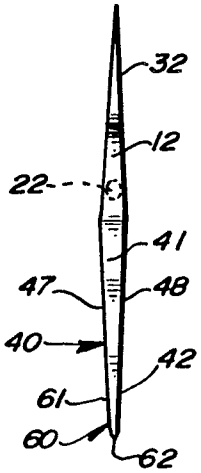
FIG. 2 shows an end elevation view of the hair weaving comb at lines 2—2 of FIG. 1A.

The elongate rattail extension 20 forms a substantially straight line with the elongate support member 11. The length of the elongate rattail extension 20 is typically approximately the length of the elongate support member 11. As shown in FIG. 2, the rattail extension 20 may decrease in width and thickness from the wide end 21 to the pointed end 22. It should be noted that the rattail extension 20 may be shorter or longer than the support member 11. Furthermore, the rattail extension 20 may be absent from the hair weaving comb 10.

The first edge portion 14 of the support member 11 is integrally connected to a comb 30. The comb 30 includes a plurality of teeth 31 integrally affixed to and extending from the edge portion 14. The comb 30 further includes a pair of thicker tapering reinforced ends 32, 33 designed for safety and support and integrally connected to and extending from the edge portion 14. Comb end 32, 33 are connected to edge portion 14 near support member ends 12, 13, respectively. Comb end 32 includes a substantially straight edge 34 and a tapering edge 35. Comb end 33 includes a substantially straight edge 36 and a tapering edge 37. Tapering edge 37 leads into tapering edge 23 of the rattail extension 20.

The teeth 31 and the comb ends 32, 33 are substantially equal in length and are disposed in substantially the same plane. It should be noted that the edge portion 14, the support member 12, or the rattail extension 20, or a combination thereof may form a handle for the comb 30 or the hair weaving comb 10.

Edge portion 15 of the support member 11 is connected to a set of elongate, plastic like legs or teeth or hair subsection creating means 40. Each of the legs 40 includes a proximal end portion 41 integrally connected to edge portion 15. Each of the legs 40 extends from its proximal end portion 41 to a distal end portion 42. Each of the distal end portions 42 forms a concave edge or curved recess 43.

Each of the legs 40 further includes a pair of respective first and second, opposing, substantially straight side edges 44, 45 extending from the proximal end portion 41 to the distal end portion 42. Except for the outermost edges of the outermost legs 40 connected near the support member ends 12, 13, the edges 44, 45 lead into a set of curved or concave edge portions 46 formed in edge portion 15 of the support member 11. Each concave edge portion 46 leads into the first edge 44 of one of the legs 40 and into the second edge 45 of an adjacent leg 40.

As shown in FIG. 2, each of the legs 40 further includes a pair of respective first and second, opposing, tapering faces 47, 48 extending from the proximal end portion 41 to the distal end portion 42. It should be noted that the side edges 44, 45 may also be tapered so that each of the legs 40 may form a conical-like shape or a frustoconical shape.

Legs 40 which are adjacent to each other form a set of hair sub-section receiving means or slots or spaces 50. One such slot 50 is formed by the first edge 44 of one of the legs 40, the second edge 45 of an adjacent leg 40, and a respective concave edge portion 46. Each slot 50 runs from the concave edge portion 46 of the edge portion 15 of the support member 11 to the proximal end portions 41 of the legs 40 to the distal end portions 42 of the legs 40.

The legs 40 include hair sub-section creating means or teeth 60 integrally connected to each of the distal end portions 42. Each tooth 60 includes a proximal end 61 integrally connected to the concave edge 43. Each tooth of the teeth 60 extends from its proximal end 43 to a distal end 62. The distal ends 62 of the teeth 60 form a substantially straight line running substantially parallel to the elongate support member 11. It should be noted that each of the hair receiving spaces or slots 50 is formed in part by a respective outer tooth 63 of one of the legs 40 and an outer, opposing tooth 64 of a respective adjacent leg 40.

Figure 10:
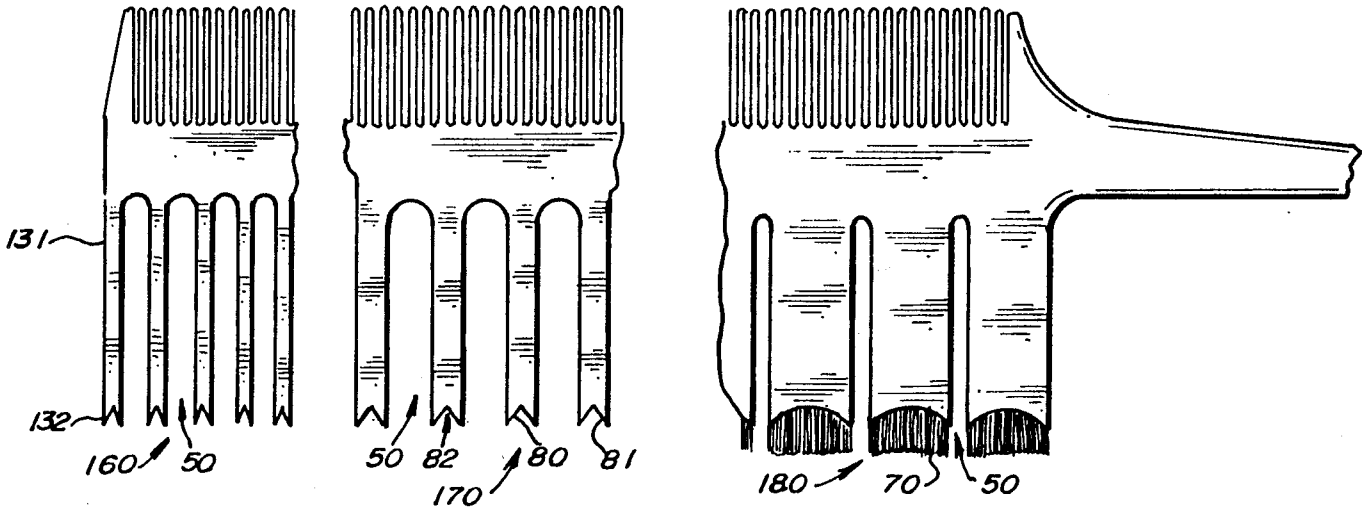
FIG. 10 shows portions of more alternate embodiments of the hair weaving comb for rapidly and evenly weaving hair for highlighting.

The legs 40, the support member 11, rattail extension 20, and comb 30 are typically disposed in substantially the same plane. The teeth 60, legs 40, and teeth 31 of the comb 30 are typically formed parallel to each other. It should be noted that the teeth 60 may not only be disposed in a longitudinal row on each of the concave edges 43, but also be disposed in a lateral or transverse row or column on each of the concave edges 43. As shown in FIG. 10, the teeth 60 may also take the form of brush-like bristles 70 affixed in the distal end portion 42 in a row and column like form or in an array with the bristles disposed longitudinally and transversely or laterally. It should also be noted that the distal end portion 42 may include a substance such as a velcro-like fabric to catch and divide out sub-sections of hair.

Figure 1B:
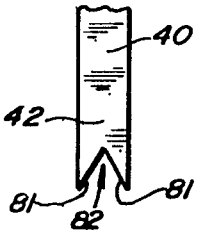
FIG. 1B shows a partial side elevation view of one of the legs of the preferred embodiment of the hair weaving comb.
Figure 3:
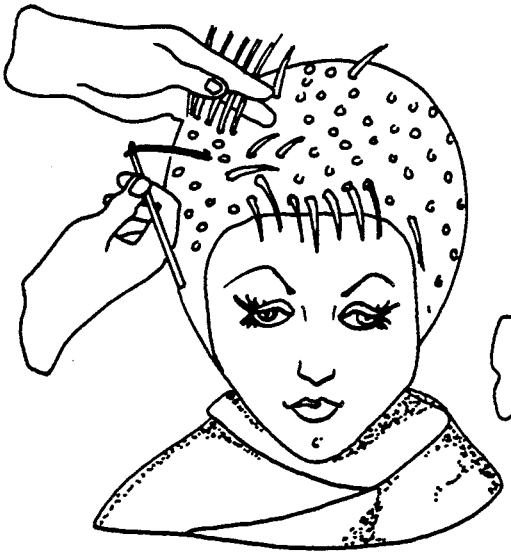
FIG. 3 shows a perforated cap and crochet hook for use in the first basic prior art highlighting method.
Figure 4A:
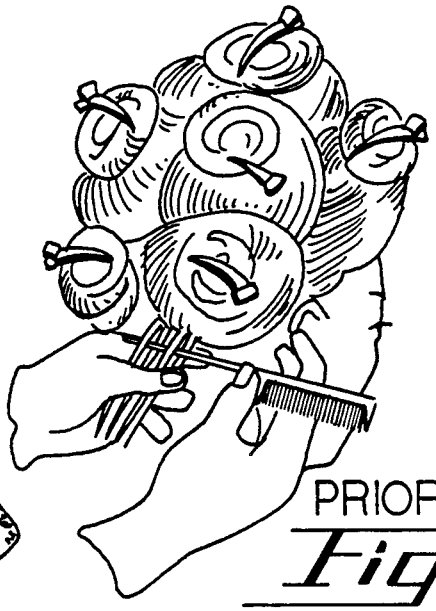
PRIOR ART Fig. 4A.
FIG. 4A shows a conventional rattail comb for use in the second basic prior art highlighting method.
Figure 4B:
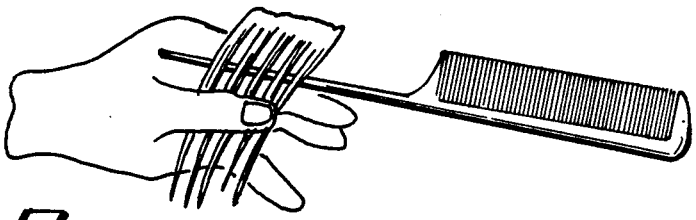
PRIOR ART Fig. 4B.
FIG. 4B shows a detail view of a portion of FIG. 4A.
Figure 9:
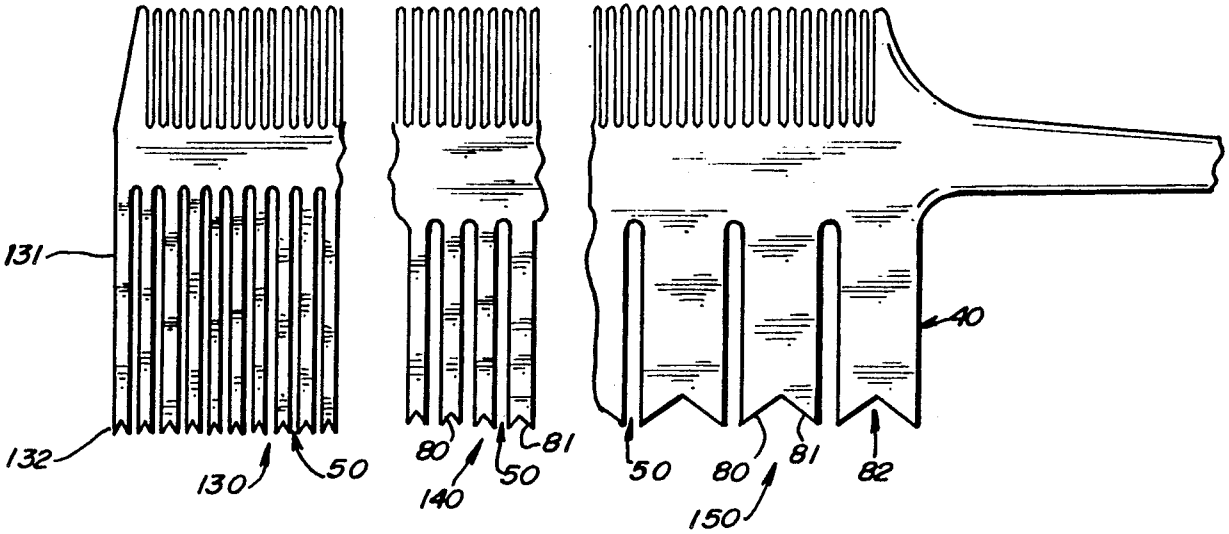
FIG. 9 shows portions of alternate embodiments of the hair weaving comb for rapidly and evenly separating hair for highlighting.

Furthermore, in the preferred embodiment of the invention, as shown in FIGS. 1B, 9 and 10, the teeth 60 may take the form of a pair of tapering teeth 80, 81 integrally extending from each of the distal end portions 42 of each of the legs 40. Each pair of tapering teeth 80, 81 may form an inverted V-shaped recess 82. The teeth 80, 81 and recess 82 readily create, displace and release hair sub-sections. It should also be noted that the teeth 60 may be excluded from the legs 40 of the comb 10 shown in FIG. 1A, and the distal end 42 forming the curved recess 43 may be utilized to readily create, displace and release hair sub-sections.

Figure 5:
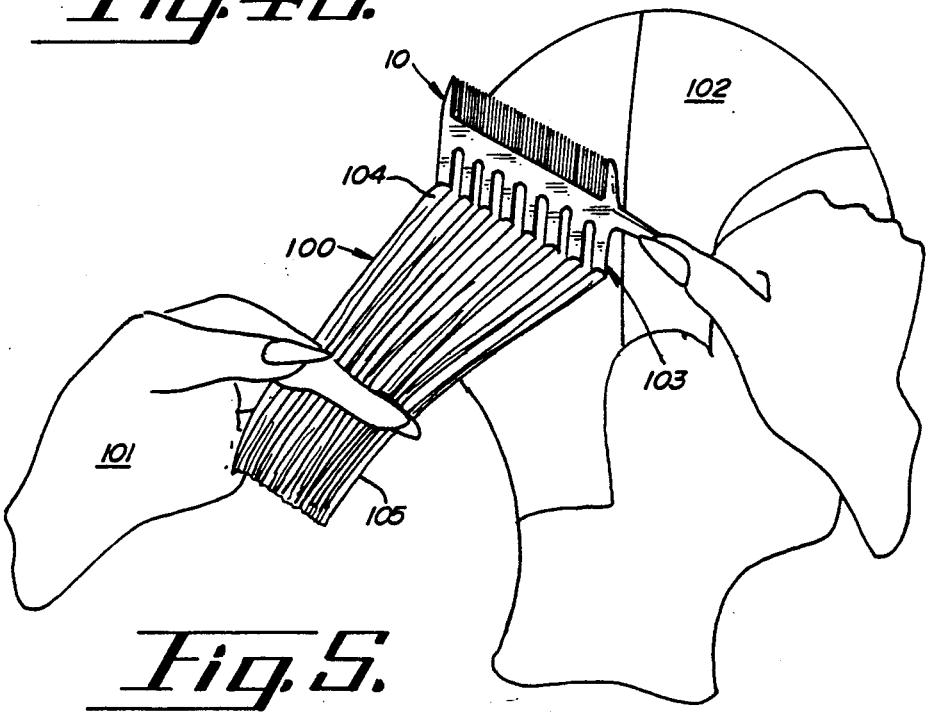
FIG. 5 shows the hair weaving comb of FIG. 1A approaching a section of hair to be separated for highlighting.
Figure 8:
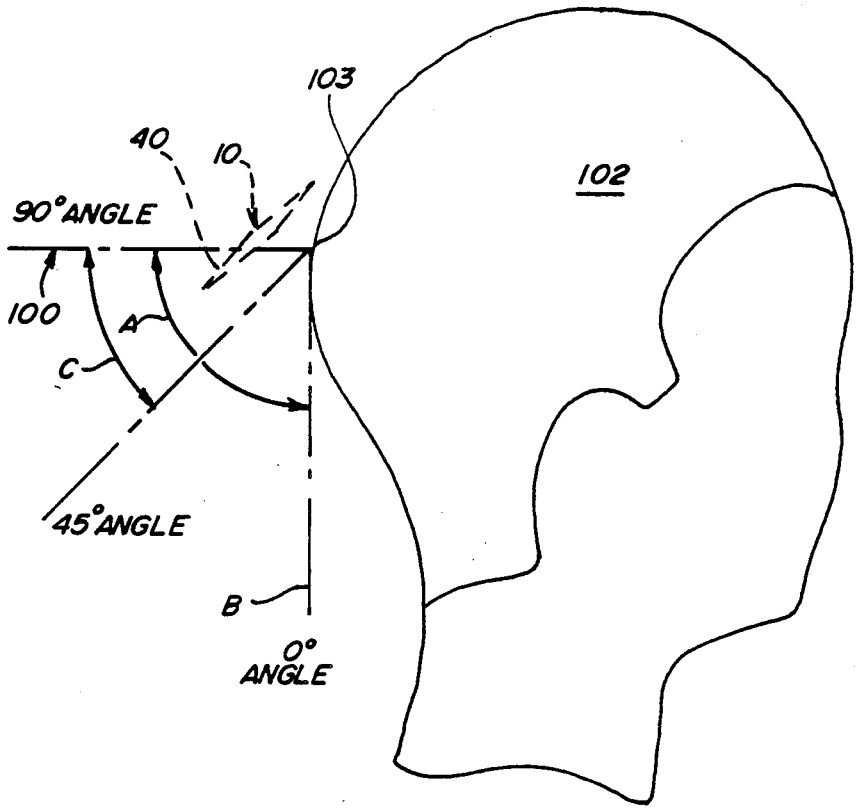
FIG. 8 is a diagrammatic view of a head showing the hair weaving comb 10 entering a section of hair at a desired location and angle.

In operation, the hair weaving comb 10 approaches a section 100 of hair at about a 45° angle, such as in FIGS. 5 and 8. The hair section 100 is held in a hand 101 of a stylist at typically an angle A of 90° from a tangent B which hypothetically intersects a customer's head 102 at a root area 103 of the hair section 100, as shown in FIG. 8. The legs 40 are typically disposed at approximately an angle C of 45° relative to the hair section 100. As shown in FIGS. 5 and 8 the legs 40 usually enter and move through the hair section 100 at such an angle near the head 102 of the customer. Proximal end or hair root portions 104 of strands of hair may tend to be more ordered and less snarled near the root area 103 than their distal end portions 105, such as distal end portions 105 held in the hand 101 of the stylist. Accordingly, a more even separation of hair may occur when the legs 40 enter and divide the hair section 100 near the head 102.

Figure 7:
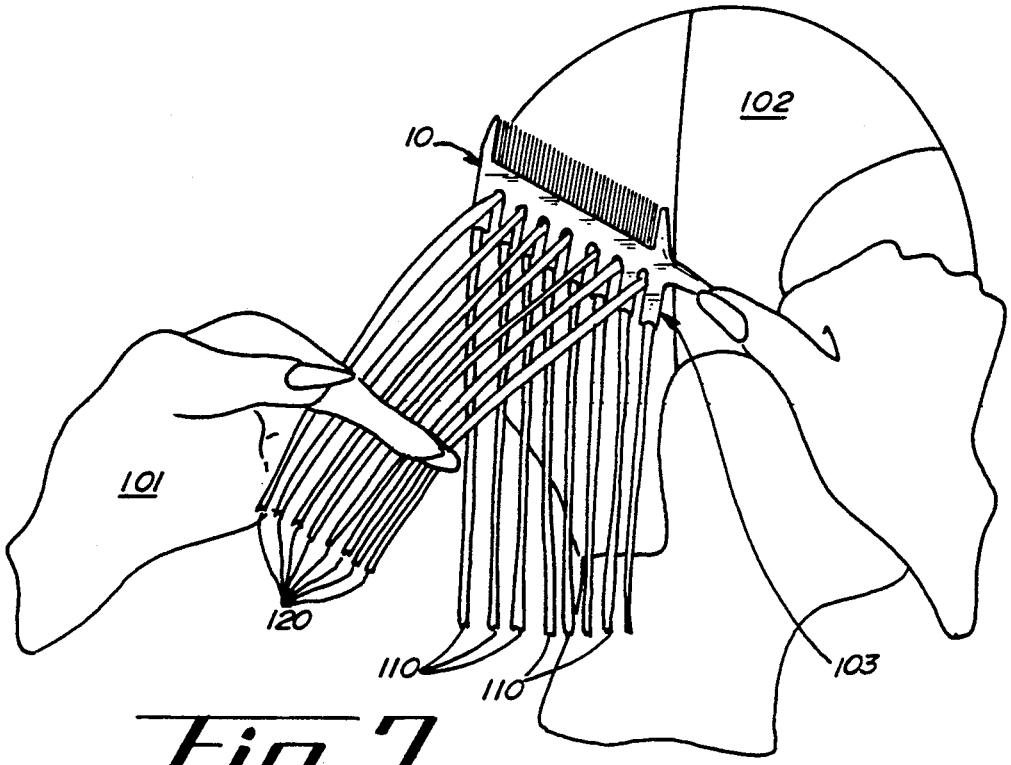
FIG. 7 shows a section of hair which has been separated for highlighting by the hair weaving comb of FIG. 1A.

As the hair weaving comb 10 enters the hair section 100 at angle C of 45°, the distal end portions 62 of teeth 60 simultaneously enter the hair section 100. As the distal end portions 62 enter and move through the hair section 100 each set of teeth 60 of each of the legs 40 creates an alternate hair sub-section 110 as shown in FIG. 7 by snaring or catching or grabbing the hair sub-sections. As the legs 40 move downwardly, each of the concave edge portions 43 of each of the distal end portions 42 then pushes the respective sub-sections 110 out of and away from the hair section 100. The concave edge portions 43 may aid in the creating or catching or grabbing of the sub-sections 110. The strands of hair in the sub-sections 110 may slide on the concave edge portions 43 toward the middle of each of the respective concave edge portions 43 and away from its respective adjacent hair-receiving slot 50. With the embodiment having the inverted V recess 82 and tapering teeth 80, 81, the strands of hair in the sub-sections 110 may actually slide all the way to the middle of the recess 82. The comb-like teeth 63 may group hair together and hold the hair until the legs 40 are moved all the way into the hair section 100 and sub-sections 110 are divided down and away from its respective adjacent hair receiving slot 50.

Figure 6:
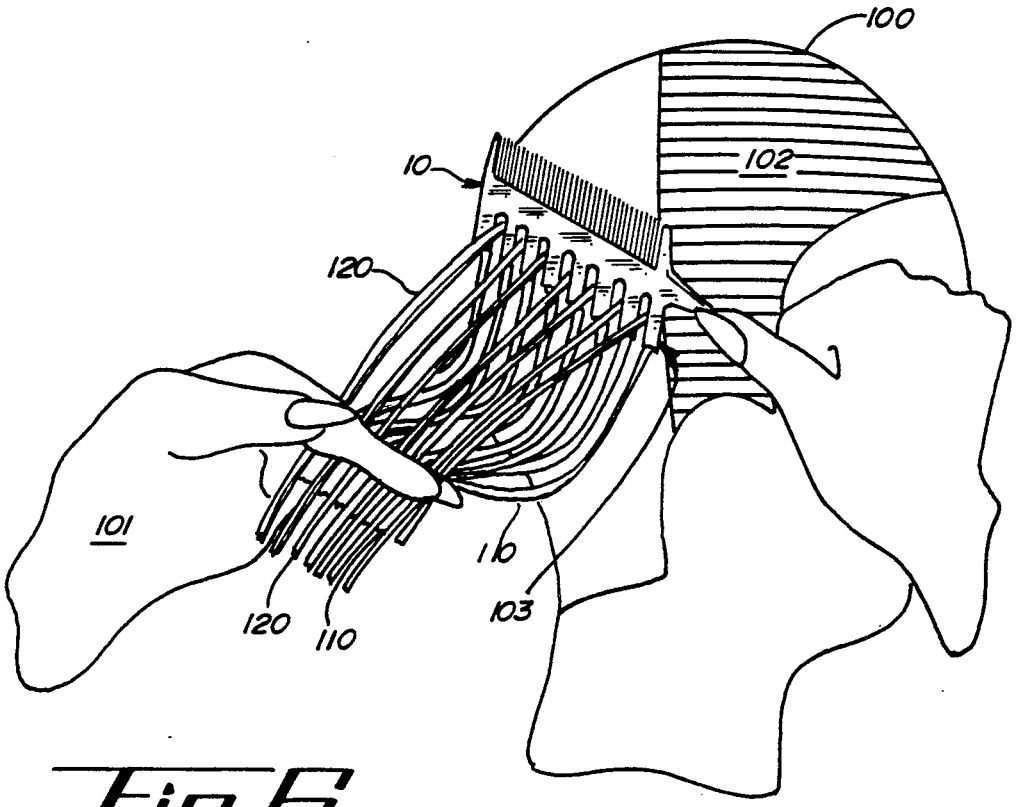
FIG. 6 shows the hair weaving comb of FIG. 1A in the process of separating a section of hair for highlighting.

As the distal end portions 62 of the teeth 60 enter the hair section 100 simultaneously, the distal end portion 62 of each of the outer teeth 63 and the distal end portions 62 of each of the outer opposing teeth 64 creates an alternate hair sub-section 120 as shown in FIG. 6. As the legs 40 further enter and move through the hair section 100, the opposing side edges 44, 45 of adjacent legs 40 slide smoothly against hair strands of each of the hair sub-sections 120.

As the distal end portions 42 of the legs 40 push or separate the sub-sections 110 out of the hair section 100 and away from the sub-sections 120 and before the concave edge portions 46 are brought to bear against the hair sub-sections 120, the distal end portions 105 of hair sub-sections 110 are pulled out of the hand 101 by the distal end portions 42 of the legs 40 being pushed against the proximal hair end or root portions 104. As the hair sub-sections 110 are pulled out of the hand 101, the hair sub-sections 110 readily fall out of the distal end portions 42 and to the head 102 of the customer, as shown in FIG. 7.

It should be noted that as the legs 40 enter the section 100 simultaneously and move through the section 100, the legs 40 move in generally the direction of angle C of 45°. However, the legs 40 may be disposed at anywhere from 10° to 170° relative to the hair section 100 to separate the section 100 into sub-sections 110, 120. It should also be noted that the distal end portions 42 of the legs 40 may enter the section 100 sequentially, with the distal end portions 42 entering the hair section 100 and creating sub-sections 110, 120 progressively.

After the sub-sections 110 have been separated from the sub-sections 120 by the legs 40, sub-sections 120 remains in the hand 101 of the stylist. Sub-section 120 may subsequently be confined to a protective piece of foil or plastic and treated with highlighting chemicals in a conventional fashion.

A set of hair weaving combs 10 may include the alternate embodiments shown in FIGS. 9 and 10. An alternate embodiment 130 includes a set of integral plastic like extremely narrow legs 131. Each leg 131 includes a pair of inverted V-shaped teeth-like distal end portions 132. Alternate embodiments 140 and 150 include tapering teeth 80, 81. Embodiments 130, 140, and 150 have spaces 50 of substantially equal width, but form hair sub-sections 110 of different width. Respective embodiments 130, 140 and 150 create hair sub-sections 110 of increasingly greater width. It should be noted that while wire-like legs 40 have been contemplated, many or all states may have regulations prohibiting the use of wire or metal-like legs in combs or comb-like devices. Wire or metal may react with certain highlighting chemicals.

As shown in FIG. 10, alternate embodiment 160 includes legs 131 and distal end portions 132. Alternate embodiments 170 includes tapering teeth 80, 81. Alternate embodiment 180 includes brush-like bristles 70. Embodiments 160 and 170 create hair sub-sections 120 of a greater width than hair sub-sections 110. Embodiments 130, 140, 150 and 180 create hair sub-sections 110 of a greater width than hair sub-sections 120.

As shown by FIGS. 1A, 9, and 10, the width of each distal end portion of each of the legs may vary. Moreover, the width of each hair-receiving slot or space may vary. Accordingly, a variety of hair sub-section creating devices may be formed. Once such variety may include the following devices as listed in Table I:

TABLE I

| Color of Device | Width In Inches Of Distal End Portion Of Each Leg | Width In Inches of Each Hair-Receiving Slot Between Distal End Portions of Adjacent Legs |
|---|---|---|
| Blue | 1/10 | 1/10 |
| Pink | 2/10 | 1/10 |
| Grey | 3/10 | 1/10 |
| White | 4/10 | 1/10 |
| Purple | 5/10 | 1/10 |

Another such variety is shown below in Table II:

TABLE II

| Color of Device | Width In Inches Of Distal End Portion Of Each Leg | Width In Inches of Each Hair-Receiving Slot Between Distal End Portions of Adjacent Legs |
|---|---|---|
| Yellow | 1/10 | 1/16 |
| Peach | 2/10 | 1/16 |
| Green | 3/10 | 1/16 |
| Black | 4/10 | 1/16 |

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A hair weaving comb for rapidly separating hair for highlighting and the like comprising:

a handle;

a set of comb-like teeth integrally connected to the handle, each of the teeth being of equal length, equal width, and spaced equidistance from each other; and a set of spaced apart legs connected to and extending from the handle, each of the legs including a distal end portion, each of the distal end portions including at least two projections and a concave edge formed between and partially by the projections, each of the concave edges having a depth less than the width of its respective distal end portion, the teeth and legs being disposed substantially in a first plane with the teeth extending away from the legs, the legs forming hair receiving spaced between each other for receiving hair, the distal end portions creating hair sub-sections when the comb is inserted into a section of hair, the distal end portions displacing alternate hair sub-sections away from other alternate hair sub-sections when the comb is further inserted into the section of hair, the other alternate hair sub-sections being received by the hair receiving spaces whereby hair is separated for highlighting and the like.

2. The comb of claim 1, wherein each of the distal end portions is in line with each of the other distal end portions whereby the legs divide out hair sub-sections simultaneously from a section of hair.

3. The comb of claim 1, wherein each of the distal end portions of the legs includes at least one more projection for catching and dividing out the alternate hair sub-sections.

4. The comb of claim 1, wherein at least two brush-like, resilient projections extend from each of the concave edges.

5. The comb of claim 1 wherein each of the distal end portions is of substantially equal width so that alternate hair sub-sections, which are displaced away from other hair sub-sections, are of a substantially equal width.

6. The comb of claim 1, wherein each of the hair receiving spaces is of substantially equal width so that the other hair sub-sections, which are bypassed by the distal end portions and received by the hair receiving spaces, are of equal width.

7. The comb of claim 1, wherein the width of each of the distal end portions is greater than the width of each of the hair receiving spaces.

8. The comb of claim 1, wherein the width of each of the distal end portions is less than the width of each of the hair receiving spaces.

9. The comb of claim 1, wherein the width of each of the distal end portions is substantially equal to the width of each of the hair receiving spaces.

10. The comb of claim 1, further comprising a tapered extension having a pointed end, the extension connected to the handle, the extension being disposed in line with the handle, the extension tapering away from the handle member to the pointed end.

11. A hair weaving comb for rapidly separating hair for highlighting and the like comprising:

an elongate support member having an end and a pair of first and second opposing edges;

a set of comb-like teeth integrally connected to and extending from the first edge of the support member, each of the teeth being of equal length, equal width, and spaced equidistance from each other, the teeth being disposed in the same plane as the support member and a set of spaced apart legs integrally connected to and extending from the second edge of the support member, each of the legs being of equal length, equal width, and spaced equidistance from each other, the legs being disposed in the same plane as and opposite of the comb-like teeth, each of the legs having an integral distal end portion, each of the distal end portions having a V-shaped notch, the legs forming distal end portions for separating hair into sub-sections of hair, the legs forming hair receiving slots between each other for receiving hair, the distal end portions displacing alternate hair sub-sections away from other alternate hair sub-sections which are received by the hair receiving slots whereby hair is separated for highlighting and the like.

12. A method for creating and separating sub-sections of hair from a section of hair for highlighting and the like with a handle having a tapered extension, a set of comb-like teeth, and a set of spaced apart legs, each of the teeth being of equal length, equal width, and spaced equidistance from each other, the teeth being disposed opposite of the spaced apart legs, each of the legs being of equal length, equal width and spaced equidistance from each other, each of the legs having a distal end portion with two projections and an edge with depth formed between and partially by the projections, the depth of the edge being less than about one-half of the length of each of its respective legs, the method comprising the steps of:

forming a section of hair with the tapered extension;

combing, detangling and smoothing to prepare the section of hair with the comb-like teeth after the section of hair is formed by the tapered extension;

creating sub-sections of hair from the section of hair by inserting the distal end portions into the section of hair after the steps of combing, detangling and smoothing to prepare the section of hair, the distal end portions being inserted from above the section of hair;

displacing alternate sub-sections down and away from other sub-sections by pushing the distal end portions through the section of hair after the sub-sections of hair have been created; and allowing the other sub-sections of hair to be subsequently received in the spaces between the distal end portions whereby a section of hair is separated for highlighting and the like.

13. The method of claim 12, wherein the step of creating of sub-sections of hair includes simultaneously inserting the distal end portions into the section of hair whereby sub-sections of hair are created substantially simultaneously.

14. The method of claim 12, wherein the step of creating sub-sections of hair includes sequentially inserting the distal end portions into the section of hair whereby sub-sections of hair are created progressively.

15. A hair weaving comb for rapidly separating hair for highlighting and the like comprising:

a handle having a pair of edges and a pair of handle ends, a tapered extension integrally connected to and tapering away from one of the handle ends, the extension being disposed substantially in line with and in the same plane as the handle, a set of comb-like teeth integrally connected to and extending from one of the edges, each of the teeth being of equal length, equal width, and spaced equidistance from each other; the teeth being disposed in the same plane as the handle, and a set of spaced apart legs integrally connected to and extending from the other edge, each of the legs being of equal length, equal width, and spaced equidistance from each other, the legs being disposed in the same plane as and opposite of the comb-like teeth, each of the legs having an integral distal end portion, each of the distal end portions having two projections and an edge with depth formed between and partially by the projections, the depth of each of the edges of the legs being less than one-half the length of its respective leg, and the legs forming hair receiving spaced between each other for receiving hair, the distal end portions creating hair sub-sections when the comb is inserted into a section of hair, the distal end portions displacing alternate hair sub-sections away from other alternate hair sub-sections when the comb is further inserted into the section of hair, the other alternate hair sub-sections being received by the hair receiving spaces whereby hair is separated for highlighting and the like.

16. The comb of claim 15 wherein each of the distal end portions is of substantially equal width so that alternate hair sub-sections, which are displaced away from other hair sub-sections, are of a substantially equal width.

17. The comb of claim 15, wherein each of the hair receiving spaces is of substantially equal width so that the other hair sub-sections, which are by passed by the distal end portions and received by the hair receiving spaces, are of equal width.

18. The comb of claim 15, wherein the width of each of the distal end portions is greater than the width of each of the hair receiving spaces.

19. The comb of claim 15, wherein the width of each of the distal end portions is less than the width of each of the hair receiving spaces.

20. The comb of claim 15, wherein the width of each of the distal end portions is substantially equal to the width of each of the hair receiving spaces.

21. The comb of claim 15 wherein each of the edges of the legs includes a V-shaped notch.

22. The comb of claim 15 wherein each of the edges of the legs is concave.

23. A hair weaving comb for rapidly separating hair for highlighting and the like comprising:

a handle; and a set of spaced apart legs connected to and extending from the handle, each of the legs including a distal end portion, each of the distal end portions including at least two projections and an edge with depth formed between and partially by the projections, the depth of each of the edges being less than about one-half of the length of its respective leg, and the legs forming hair receiving spaces between each other for receiving hair, the distance between the projections of each of the legs being less than the width of each of the hair receiving spaces formed by the legs, the distal end portions creating hair sub-sections when the comb is inserted into a section of hair, the distal end portions displacing alternate hair sub-sections away from other alternate hair sub-sections when the comb is further inserted into the section of hair, the other alternate hair sub-sections being received by the hair receiving spaces whereby hair is separated for highlighting and the like.

24. A hair weaving comb for rapidly separating hair for highlighting and the like comprising:

a handle having a pair of edges and a pair of handle ends, a tapered extension integrally connected to and tapering away from one of the handle ends, the extension being disposed substantially in line with and in the same plane as the handle, the extension having a generally pointed end, and a set of spaced apart legs integrally connected to and extending from the other edge, each of the legs being of equal length, equal width, and spaced equidistance from each other, the legs being disposed in the same plane as and opposite of the comb-like teeth, each of the legs having an integral distal end portion, each of the distal end portions having a V-shaped notch, and the legs forming hair receiving spaces between each other for receiving hair, the distal end portions creating hair sub-sections when the comb is inserted into a section of hair, the distal end portions displacing alternate hair sub-sections away from other alternate hair sub-sections when the comb is further inserted into the section of hair, the other alternate hair sub-sections being received by the hair receiving spaces whereby hair is separated for highlighting and the like.

25. A hair weaving comb for rapidly separating hair for highlighting and the like comprising:

a handle having a pair of edges and a pair of handle ends, a tapered extension integrally connected to and tapering away from one of the handle ends, the extension being disposed substantially in line with and in the same plane as the handle, a set of comb-like teeth integrally connected to and extending from one of the edges, each of the teeth being of equal length, equal width, and spaced equidistance from each other, the teeth being disposed in the same plane as the handle, and a set of spaced apart legs integrally connected to and extending from the other edge, each of the legs being of equal length, equal width, and spaced equidistance from each other, the legs being disposed in the same plane as and opposite of the comb-like teeth, each of the legs having an integral distal end portion, each of the distal end portions having a V-shaped notch, and the legs forming hair receiving spaces between each other for receiving hair, the distal end portions creating hair sub-sections when the comb is inserted into a section of hair, the distal end portions displacing alternate hair sub-sections away from other alternate hair sub-sections when the comb is further inserted into the section of hair, the other alternate hair sub-sections being received by the hair receiving spaces whereby hair is separated for highlighting and the like.

* * * * *

UNITED STATES PATENT AND TRADEMARK OFFICE

CERTIFICATE OF CORRECTION

PATENT NO. : 4,993,438

DATED : February 19, 1991

INVENTOR(S) : Marjorie A. Hunt

It is certified that error appears in the above-identified patent and that said Letters Patent is hereby corrected as shown below:

Column 2, line 28, delete "o" and replace it with --or--.

Column 9, line 50, delete "Spaced" and replace it with --spaces--.

Column 11, line 51, delete "spaced" and replace it with --spaces--.

Signed and Sealed this

Twenty-eighth Day of July, 1992

*Attest:*

DOUGLAS B. COMER

*Attesting Officer*

*Acting Commissioner of Patents and Trademarks*